US006418730B1

(12) United States Patent
Tremblay et al.

(10) Patent No.: US 6,418,730 B1
(45) Date of Patent: Jul. 16, 2002

(54) DISPENSER FOR WARM OR COLD BEVERAGES

(76) Inventors: Clermont Tremblay, 200, R.R.1; Normand Tremblay, 14, rue Brassard, both of St-André(CA), G0W 2K0

( * ) Notice: Subject to any disclaimer, the term of this patent is extended or adjusted under 35 U.S.C. 154(b) by 0 days.

(21) Appl. No.: 09/786,656

(22) PCT Filed: Sep. 8, 1999

(86) PCT No.: PCT/CA99/00827

§ 371 (c)(1),
(2), (4) Date: May 9, 2001

(87) PCT Pub. No.: WO00/14008

PCT Pub. Date: Mar. 16, 2000

(30) Foreign Application Priority Data

Sep. 8, 1998 (CA) ..... 2243870

(51) Int. Cl.[7] ..... F25B 25/02
(52) U.S. Cl. ..... 62/3.64; 62/389
(58) Field of Search ..... 62/389, 3.64; 222/146.1, 222/146.2, 146.5

(56) References Cited

U.S. PATENT DOCUMENTS 4,450,987 A 5/1984 Boettcher et al.
4,792,059 A * 12/1988 Kerner et al. ..... 222/67
4,866,945 A * 9/1989 Bender et al. ..... 62/3.61
5,560,211 A * 10/1996 Parker ..... 62/3.63
6,003,318 A * 12/1999 Busick et al. ..... 62/3.64

FOREIGN PATENT DOCUMENTS

| | | |
|---|---|---|
| FR | 2 540 850 | 8/1984 |
| FR | 2 738 006 | 2/1997 |
| WO | WO90/02301 | 3/1990 |

* cited by examiner

*Primary Examiner*—Denise L. Esquivel
*Assistant Examiner*—Melvin Jones
(74) *Attorney, Agent, or Firm*—Collard & Roe, P.C.

(57) ABSTRACT

A water storing apparatus (10) suitable for outdoor and indoor installation, and adapted to maintain drinking water within a predetermined range of temperature. The apparatus has a water tank (12) containing the drinking water with a temperature sensor (24) for sensing the water's temperature. The temperature of the drinking water can be changed by either a heater or a cooler, which are both in contact with a heat conductive member (30) itself in thermal contact with the water tank (12). In this manner, the water temperature can either be increased or decreased as needed to be maintained within an appropriate predetermined range.

18 Claims, 6 Drawing Sheets

DISPENSER FOR WARM OR COLD BEVERAGES

CROSS REFERENCE TO RELATED APPLICATIONS

Applicants claim priority under 35 U.S.C. §119 of CANADIAN Application No. 2,243,870 filed Sep. 8, 1998. Applicants also claim priority under 35 U.S.C. §120 of PCT/CA99/00827 filed on Sep. 8, 1999. The international application under PCT article 21 (2) was published in English.

FIELD OF THE INVENTION

The present invention relates to the safe storing of drinking water and more particularly concerns a water storing apparatus suitable for outdoor and indoor installation, and adapted to maintain drinking water within a predetermined range of temperature.

BACKGROUND

With the ever-present concern with the quality of tap water distributed both in homes and public buildings, a very popular practice is to have drinking water supplied regularly from an outside source. Such water supplies usually come in the form of large water bottles to be installed on water distributors made for this purpose. While providing good quality water to customers, this practice however has the drawback of necessitating the frequent purchase of water bottles since their water storing capacity is limited. These bottles are heavy and hard to handle. In addition, no means are provided to maintain the water in the bottles at an appropriate temperature to avoid possible contamination, which should be of about 1 to 6 degrees Celsius, resulting in restrictions on the storing and transporting conditions of the water bottles. This is particularly a problem in regions where temperatures vary greatly depending on the season. Bottle water supply is also a problem in some places and there is a need for supply of water that can be done by a specialized service without requiring direct access to the water tank or distributor.

SUMMARY OF THE INVENTION

It is therefore an object of the present invention to provide a water storing apparatus to replace the water bottle system, the apparatus being adapted to maintain the temperature of the drinking water it contains in a predetermined range of temperature no matter whether the apparatus is indoor or outdoor.

Accordingly, the present invention provides a water storing apparatus for storing drinking water and maintaining the temperature thereof within a predetermined temperature range. The apparatus has a water tank adapted to receive the drinking water, and temperature sensing means for sensing the temperature of the drinking water in the water tank.

Temperature changing means for changing the temperature of the drinking water in the water tank are also provided, the temperature changing means comprising a heat conductive member in thermal contact with the water tank, heating means for heating the drinking water through the heat conductive member, and cooling means for cooling the drinking water through the heat conductive member.

The apparatus also has control means connected to the temperature sensing means and temperature changing means. The control means are for controlling the temperature of the drinking water in the water tank by selectively activating the heating means and the cooling means depending on the temperature sensed by the temperature sensing means, so that the temperature of the drinking water is maintained within the predetermined temperature range.

Other features and advantages of the present invention will be better understood upon reading of the following non-restrictive description of embodiments thereof with reference to the appended drawings.

DESCRIPTION OF A PREFERRED EMBODIMENT OF THE INVENTION

Figure 1:
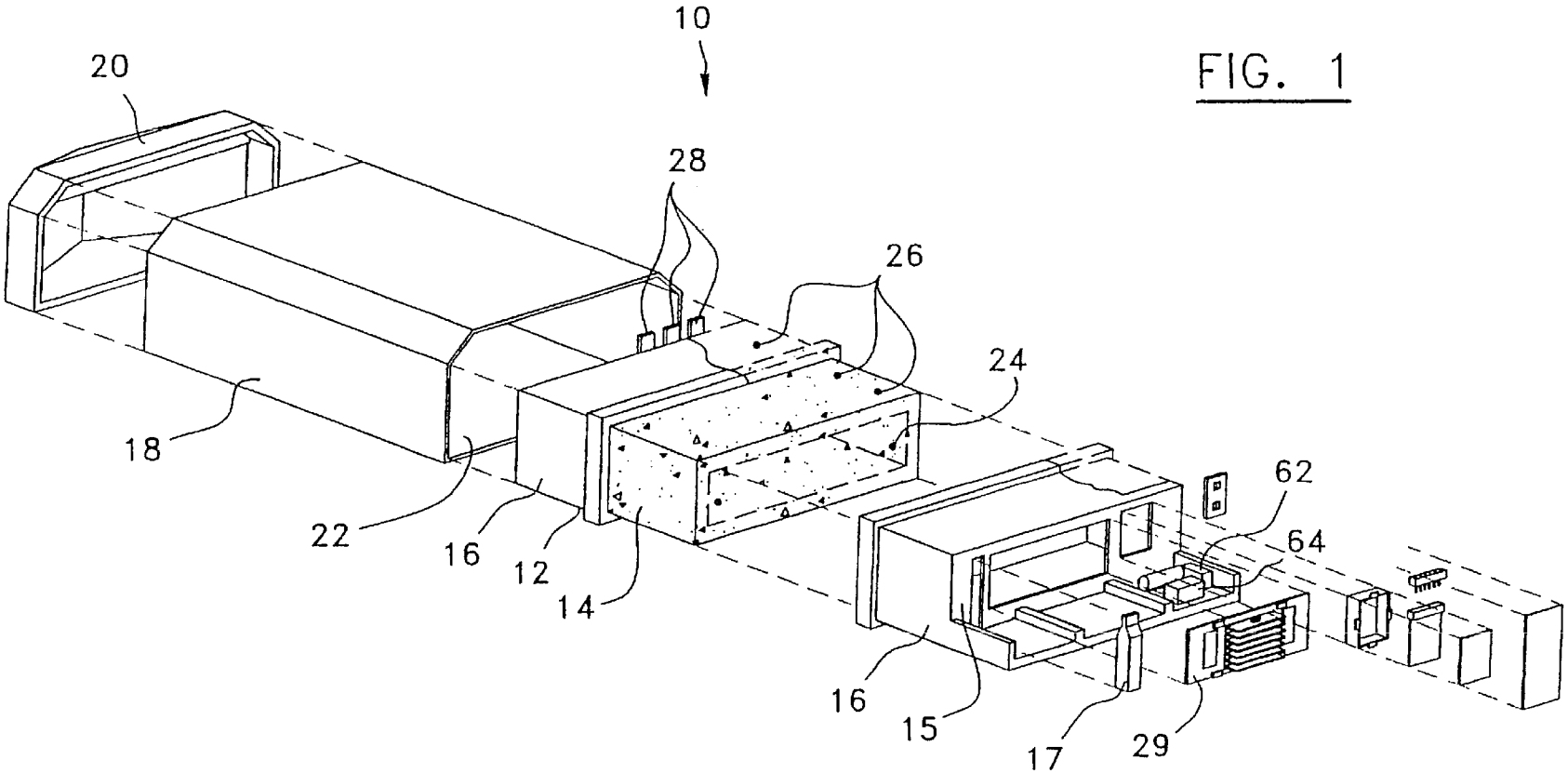
FIG. 1 is an exploded view of the water storing apparatus according to a preferred embodiment of the invention.
Figure 2:
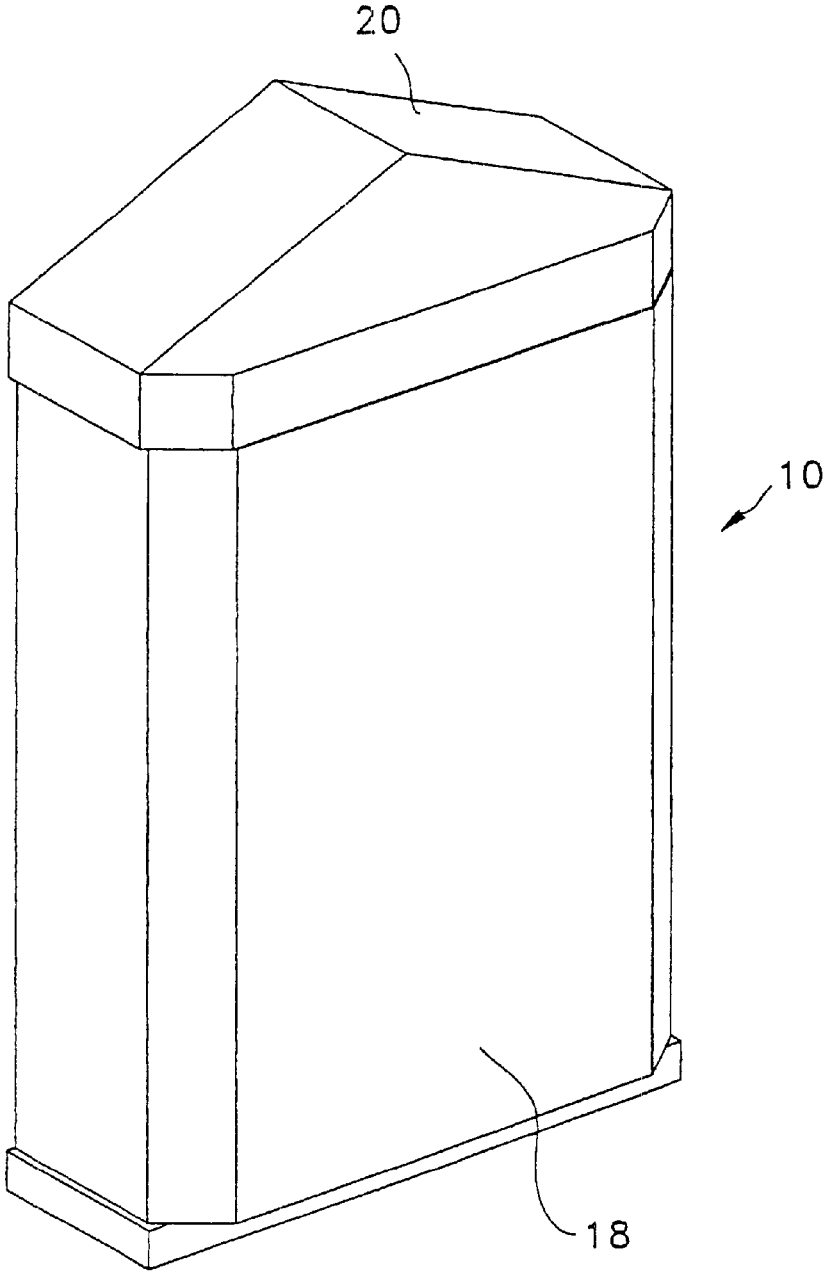
FIG. 2 is a perspective view of the apparatus of FIG. 1, assembled.

Referring to FIGS. 1 and 2, there is shown a water storing apparatus (10) for storing drinking water and maintaining its temperature within a predetermined temperature range, according to a preferred embodiment of the invention. The predetermined temperature range is preferably of about 2 to 6 degrees Celsius.

The apparatus (10) has a water tank (12) which adapted to receive the drinking water, and preferably has a water storing capacity of about 100 liters. The water tank (12) is preferably made of natural polypropylene and is received in a housing (16), which supports the whole apparatus. A thermally insulating layer (14) extends around the water tank (12). In the preferred embodiment of the invention, the thermally insulating layer (14) is made of an aluminum membrane wrapped in a very thin layer of transparent plastic, a layer of polystyrene and a thermo-foil layer. The water tank are preferably provided with threaded adapters of ⅜, ½, and ¾ inch for receiving a 10 microns air filter (not shown) and a filling up inlet. The main water outlet (15) at the bottom of the water tank (12) includes two ⅜ inch outlets and a ¾ inch draining outlet provided with a cap. The two ⅜ outlets each have a 90 degrees threaded adapter and are adapted to receive a ⅜ inch plastic tube. Water to be taken to the consumers exits the tank (12) from these two outlets. If the apparatus is installed outdoors, a 1¼ inch hole may be made in the building wall and a pipe of the same diameter is inserted therethrough, the plastic tube and necessary electric wiring entering the building through that pipe. An insulated plastic cover (17) is provided for closing the main water outlet (15) while still allowing easy access thereto.

Additionally a plastic casing (18) may be provided surrounding the housing (16) and a plastic lid (20) thistle fitting over the plastic casing (18). The casing (18) and lid (20) are both preferably molded from natural polypropylene, white-washed and treated with UV light. The back portion (22) of the casing (18) may be made of a thicker plastic than the rest to be more easily hung to a building wall, for example.

Temperature sensing means for sensing the temperature of the drinking water in the water tank (12) are further provided in the apparatus (10), preferably in the form of a thermometer probe (24) extending inside the water tank (12). The probe (24) sends signals to an electronic circuit, which activates the temperature changing means. Water level detecting means for detecting a level of the drinking water in the water tank (12), such as detectors (26) height-distributed in the water tank (12), may also be provided. Each detector is made of stainless steel rod and is connected to a warning light (28), the contact of the water with the rods generating a small electric current which activates the corresponding light (28), One of detectors (26), located in the top portion of the water tank (12), may be connected to a sound alarm for indicating an overflow of the drinking water in the water tank (12). Advantageously, the thermometer probe (24) may be affixed to the lowermost of the detectors (26). An interrupter summer/winter may also be provided on top of the water tank to stop the temperature control when not needed.

In order to maintain the water temperature in the desired range, temperature changing means for changing the temperature of the drinking water in the water tank (12) are provided. They are generally received in box (29) which holds all the necessary equipment.

Figure 3:
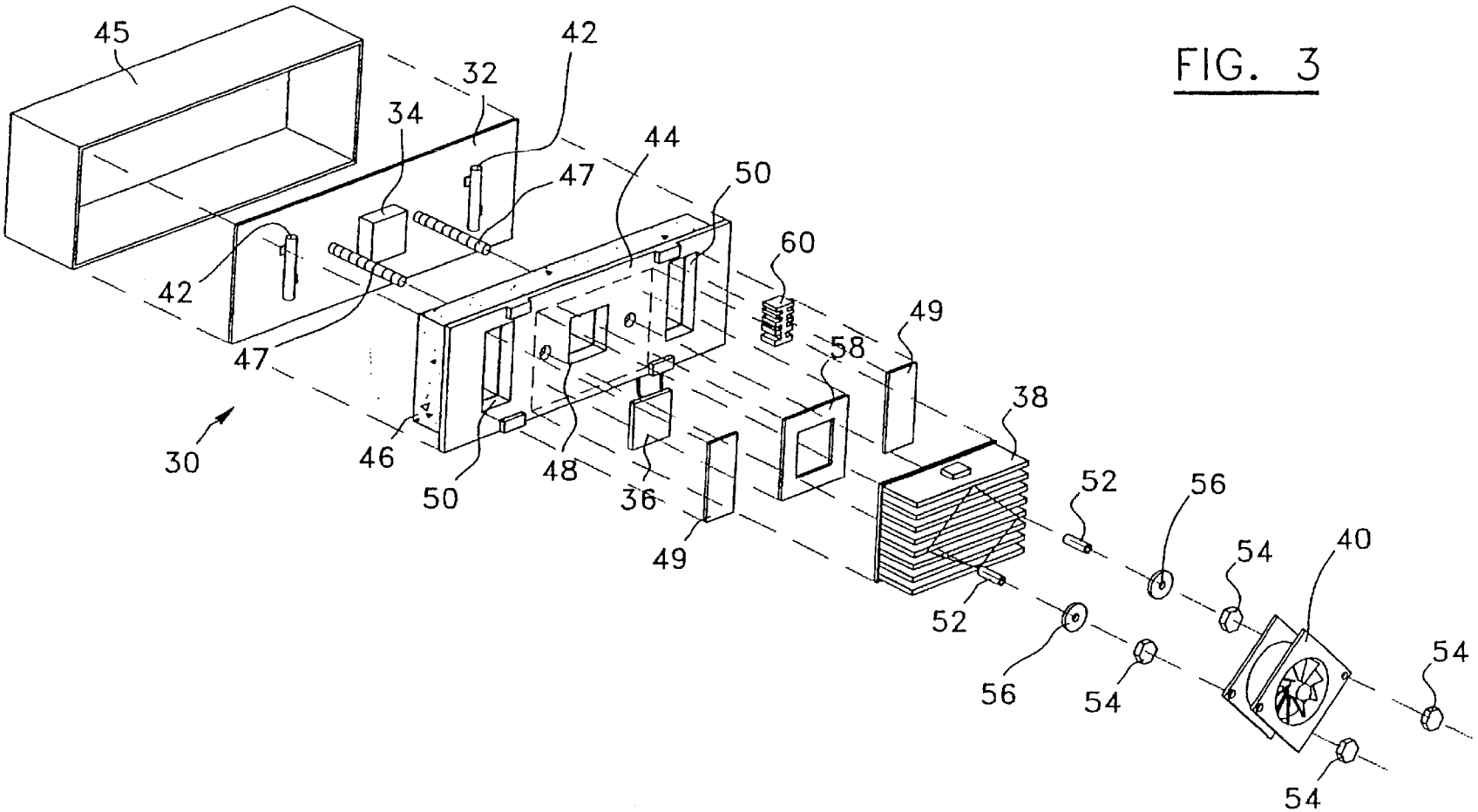
FIG. 3 is an exploded view of the temperature changing means of the apparatus of FIG. 1.
Figure 4:
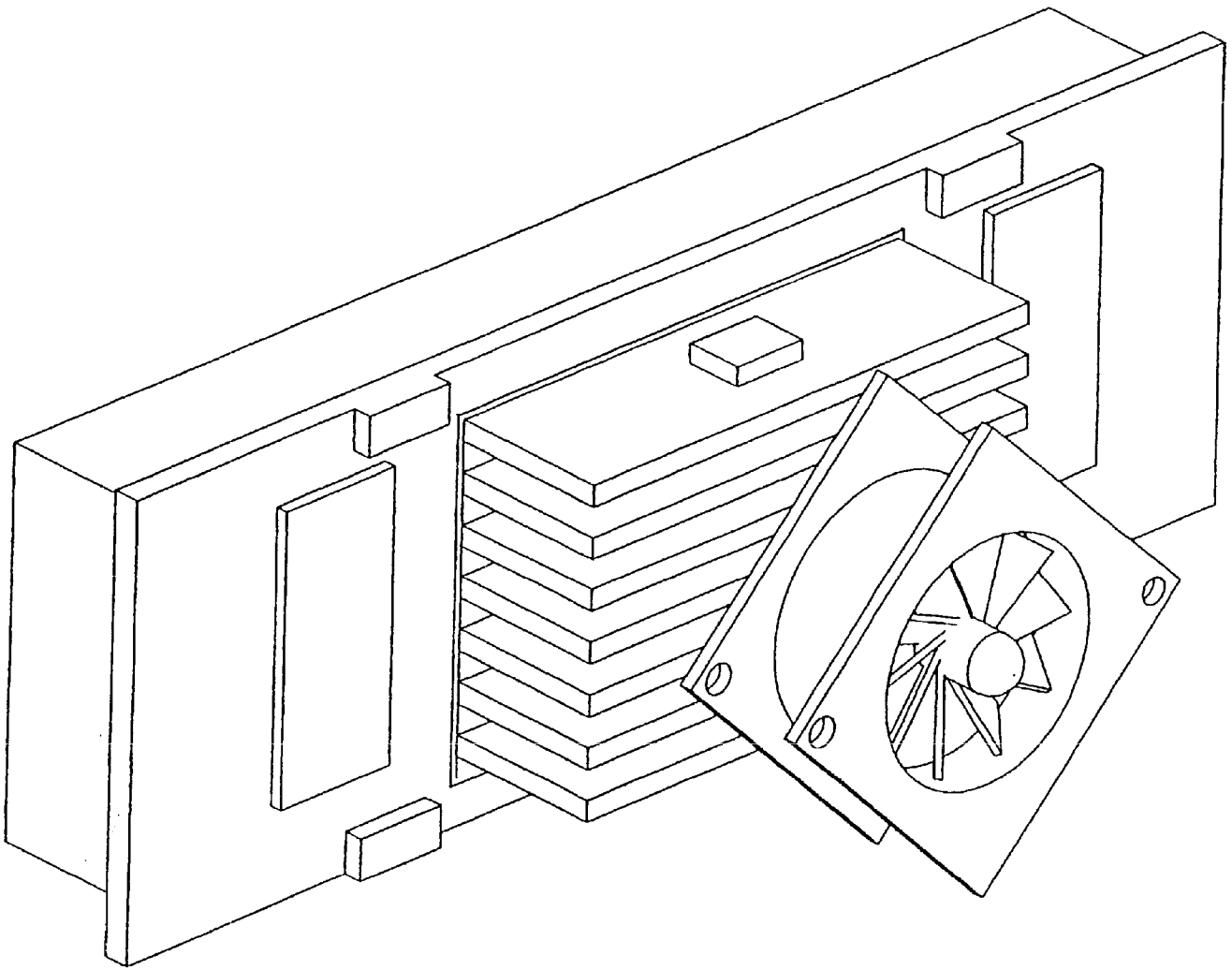
FIG. 4 is a perspective view of the temperature changing means of FIG. 3.

Referring to FIGS. 3 and 4, it can be seen that the temperature changing means includes a heat conductive member (30) in thermal contact with the water tank (12), and both heating and cooling means for heating or cooling the drinking water through the heat conductive member (30) are provided.

Preferably, the heat conductive member (30) is embodied by an aluminum plate (32) and an aluminum bloc (34) projecting from the plate (32). The aluminum plate (32) forms a wall portion of the water tank (12), and is in direct contact with the heating means. The aluminum bloc (34) has an end in thermal contact with the cooling means. In this manner, the heat conductive member (30) may induce a temperature change of the drinking water in the tank (12) either by cooling or heating it, as needed.

In the preferred embodiment, the cooling means has a thermoelectric module (36) having a side made of ceramic in contact with the aluminum block (34) for transferring cold thereto, and an opposite side also made of ceramic that corresponding get very hot. A thermal paste is provided on each side of the thermoelectric module to insure a good heat transfer. A heat exchanger (38) is provided, having a side in contact with the opposite side of the thermoelectric module (36) to extract heat therefrom. The heat exchanger (38) is preferably made from aluminum strips sealed on an aluminum plate. The opposite side of the heat exchanger is ventilated by a fan (40) of 12 volts.

The heating means are preferably embodied by resistive elements (42) distributed on the side of the aluminum plate (32) opposite to the water tank (12). The resistive elements are preferably 30 HM resistors. The heating means are particularly advantageous to prevent the drinking water from reaching the freezing point in winter, especially if the apparatus is outdoors.

A plastic bottom cover (44) and casing (45) are further preferably provided, the cover (44) having an inner portion (46) contacting the side of the aluminum plate (32) opposite the water tank (12). The inner portion (46) is filled with urethane to maintain the temperature on the aluminum plate (32). A hole (48) is performed in the bottom cover (44) for receiving the aluminum bloc (34). Additional holes (50) are also provided for the resistive elements (42). Access to the resistive elements (42) is provided through two plastic covers (49). Two threaded stems (47) hold the cover and aluminum plate together.

The pieces of the temperature changing means are preferably assembled so that a pressure of 100 square inches is applied to insure that the elements are in good contact. An insulating plate (58) is provided to stop air circulation around the thermoelectric module (36), which causes the formation of water drops. Stainless steel pipes (52), nuts (54) and rings (56) are provided to keep the pieces together. All electric wiring from the temperature changing means is connected to connector (60).

The apparatus (10) finally has control means connected to the temperature sensing means and temperature changing means, for controlling the temperature of the drinking water in the water tank (12) by selectively activating the heating means and the cooling means depending on the temperature sensed by the temperature sensing means so that the temperature of the drinking water is maintained within the predetermined temperature range.

Figure 5:
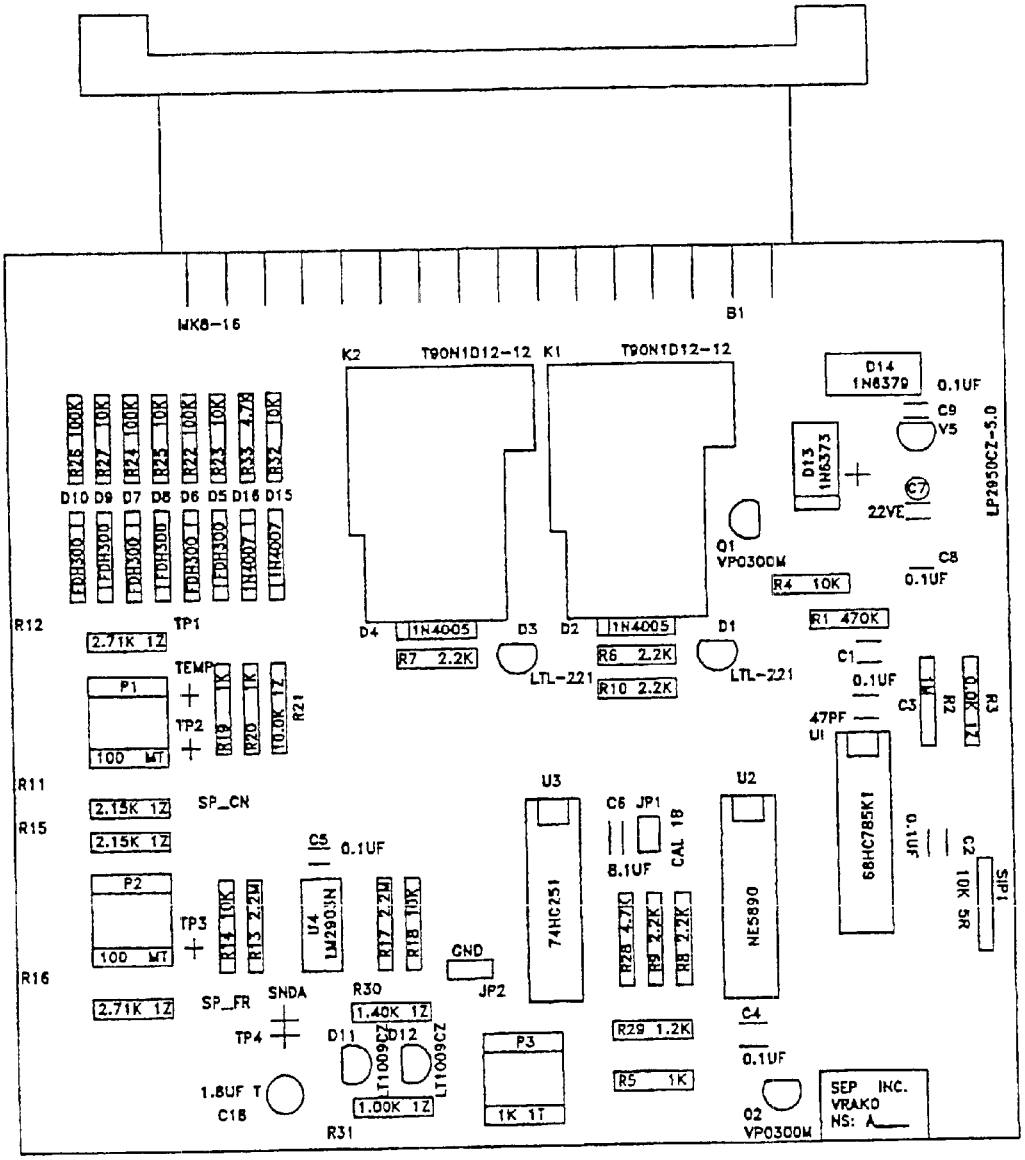
FIG. 5 shows an electric circuit for the control means of the apparatus according to the preferred embodiment of the invention.
Figure 6:
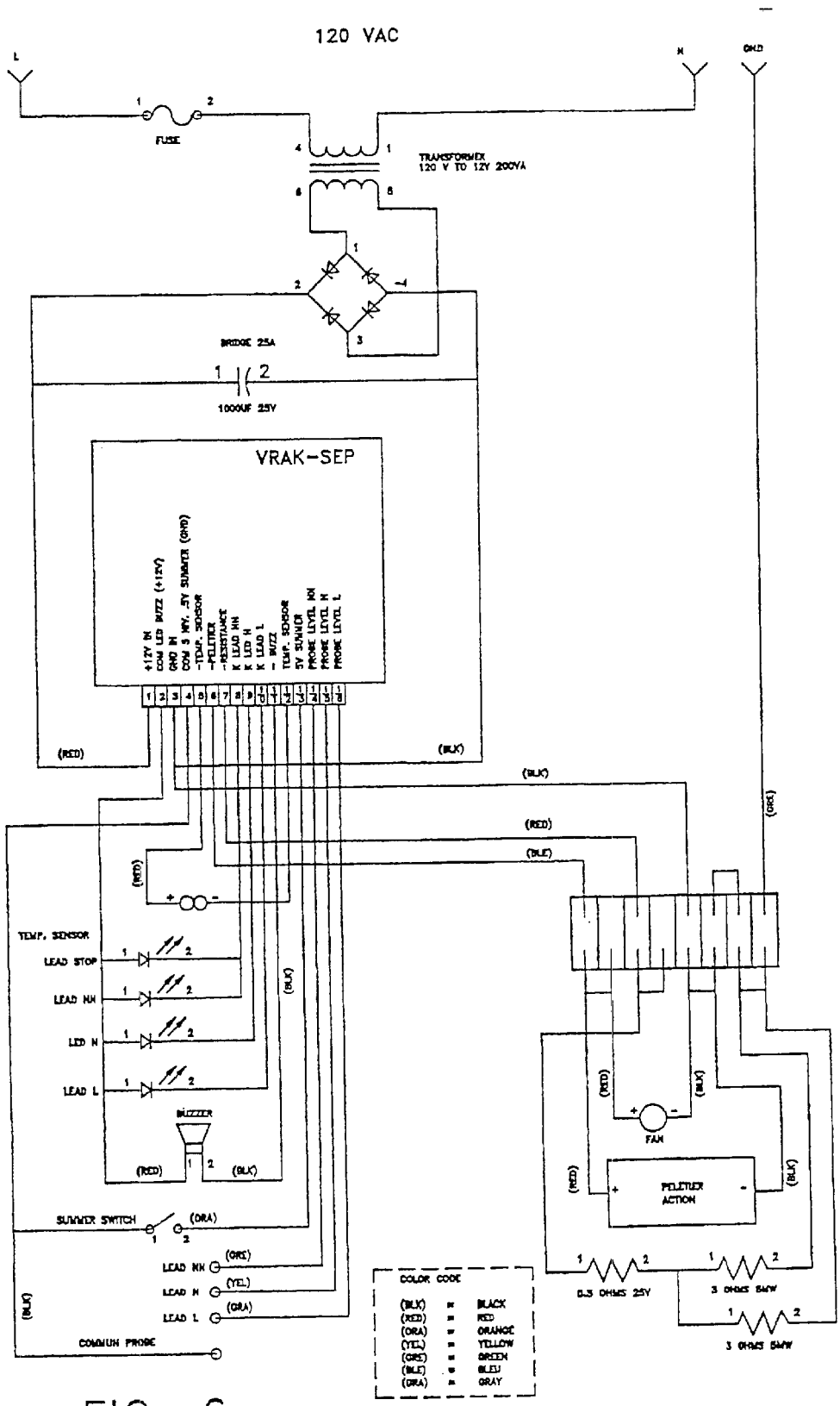
FIG. 6 is a top view of a control board for the control means of the apparatus according to the preferred embodiment of the invention.

Referring to FIGS. 5 and 6, an example of control means according to the present invention is shown. FIG. 5 shows the electric circuit mentioned above. FIG. 6 shows a control board particularly adapted to the embodiment described above. It manages the temperature control depending on the signals received from the temperature probe.

While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed is:

1. A water storing apparatus (10) for storing drinking water and maintaining the temperature thereof within a predetermined temperature range, the apparatus comprising:

a water tank (12) adapted to receive the drinking water;

temperature sensing means for sensing the temperature of the drinking water in the water tank (12);

temperature changing means for changing the temperature of the drinking water in the water tank (12), the temperature changing means comprising:

a heat conductive member (30) in thermal contact with the water tank (12);

heating means for heating the drinking water in said water tank (12) through the heat conductive member (30); and cooling means for cooling the drinking water in said water tank (12) through the heat conductive member (30); and control means connected to the temperature sensing means and temperature changing means, for controlling the temperature of the drinking water in the water tank (12) by selectively activating the heating means and the cooling means depending on the temperature sensed by the temperature sensing means so that the temperature of the drinking water is maintained within the predetermined temperature range.

2. The water storing apparatus (10) according to claim 1, wherein the predetermined temperature range is of about 2 to 6 degrees Celsius.

3. The water storing apparatus (10) according to claim 1, wherein the water tank (12) is made of polypropylene.

4. The water storing apparatus (10) according to claim 1, wherein the water tank (12) has a water storing capacity of about 100 liters.

5. The water storing apparatus (10) according to claim 1, further comprising a thermally insulating layer (14) extending around the water tank (12).

6. The water storing apparatus (10) according to claim 1, further comprising a plastic housing (16) receiving the water tank (12).

7. The water storing apparatus (10) according to claim 6, further comprising a plastic casing (18) surrounding said housing (16) and a plastic lid (20) thigltly fitting over said plastic casing (18).

8. The water storing apparatus (10) according to claim 1, further comprising water level detecting means for detecting a level of the drinking water in the water tank (12).

9. The water storing apparatus (10) according to claim 8, wherein the water level detecting means comprise a number of detectors (26) height-distributed in the water tank (12), each detector (26) being connected to a warning light (28).

10. The water storing apparatus (10) according to claim 9, wherein one of detectors (26) is located in a top portion of the water tank (12) and is connected to a sound alarm for indicating an overflow of the drinking water in the water tank (12).

11. The water storing apparatus (10) according to claim 1, wherein the temperature sensing means include a thermometer probe (24) extending inside the water tank (12).

12. The water storing apparatus (10) according to claim 1, wherein the heat conductive member (30) comprises an aluminum plate (32) forming a wall portion of the water tank (12).

13. The water storing apparatus (10) according to claim 12, wherein the aluminum plate (32) has a side opposite to the water tank (12) and provided with a projecting aluminum bloc (34) having an end in thermal contact with the cooling means.

14. The water storing apparatus (10) according to claim 13, wherein the water tank (12) comprises a plastic bottom cover (44) having an inner portion (46) contacting the side of the aluminum plate (32) opposite the water tank (12), said inner portion (46) being filled with urethane.

15. The water storing apparatus (10) according to claim 14, wherein the plastic bottom cover (44) has a hole (48) therein for receiving the aluminum bloc (34) therethrough.

16. The water storing apparatus (10) according to claim 13, wherein the cooling means comprises:

a thermoelectric module (36) having a side in contact with the aluminum bloc (34), and an opposite side;

a heat exchanger (38) having a side in contact with the opposite side of the thermoelectric module (36), and an opposite side; and a fan (40) on the opposite side of the heat exchanger (38).

17. The water storing apparatus (10) according to claim 12, wherein the heating means comprises resistive elements (42) distributed on a side of the aluminum plate (32) opposite to the water tank (12).

18. The water storing apparatus (10) according to claim 1, wherein the controlling means comprise an electronic circuit.

* * * * *